US006858363B2

(12) United States Patent
Belknap et al.

(10) Patent No.: US 6,858,363 B2
(45) Date of Patent: Feb. 22, 2005

(54) PHOTOCONDUCTIVE IMAGING MEMBERS

(75) Inventors: Nancy L. Belknap, Rochester, NY (US); Cindy C. Chen, Rochester, NY (US); Lanhui Zhang, Penfield, NY (US); Andronique Ioannidis, Webster, NY (US); James M. Duff, Mississauga (CA); John F. Graham, Oakville (CA); Timothy P. Bender, Port Credit (CA)

(73) Assignee: Xerox Corporation, Stamford, CT (US)

( * ) Notice: Subject to any disclaimer, the term of this patent is extended or adjusted under 35 U.S.C. 154(b) by 117 days.

(21) Appl. No.: 10/408,201

(22) Filed: Apr. 4, 2003

(65) Prior Publication Data

US 2004/0197686 A1 Oct. 7, 2004

(51) Int. Cl.[7] ..... G03G 5/047

(52) U.S. Cl. ..... 430/65; 430/64; 430/58.8; 430/59.4; 430/59.5

(58) Field of Search ..... 430/65, 64, 58.8, 430/59.4, 59.5

(56) References Cited

U.S. PATENT DOCUMENTS

| | | | | |
|---|---|---|---|---|
| 3,121,006 A | | 2/1964 | Middleton et al. | 96/1 |
| 3,871,882 A | | 3/1975 | Wiedemann | 96/1.5 |
| 4,265,990 A | | 5/1981 | Stolka et al. | 430/59 |
| 4,555,463 A | | 11/1985 | Hor et al. | 430/59 |
| 4,587,189 A | | 5/1986 | Hor et al. | 430/59 |
| 4,921,769 A | | 5/1990 | Yuh et al. | 430/64 |
| 5,482,811 A | | 1/1996 | Keoshkerian et al. | 430/135 |
| 6,030,735 A | * | 2/2000 | Springett | 430/58.8 |
| 6,287,737 B1 | | 9/2001 | Ong et al. | 430/58.8 |
| 6,444,386 B1 | | 9/2002 | Liu et al. | 430/64 |
| 2004/0161683 A1 | * | 8/2004 | Wu et al. | 430/59.1 |

* cited by examiner

*Primary Examiner*—Mark A. Chapman
(74) *Attorney, Agent, or Firm*—Eugene O. Palazzo

(57) ABSTRACT

A photoconductive imaging member comprised of a supporting substrate, a hole blocking layer thereover, a photogenerating layer, and a charge transport layer, and wherein the hole blocking layer is comprised of a metallic component and an electron transport component.

42 Claims, No Drawings

PHOTOCONDUCTIVE IMAGING MEMBERS

PENDING APPLICATIONS AND PATENTS

Illustrated In U.S. Ser. No. 10/408.204, filed concurrently herewith, entitled Imaging Members by Andronique Ioannidis et al., the disclosure of which is totally incorporated herein by reference, is a photoconductive imaging member comprised of a supporting substrate, and thereover a single layer comprised of a mixture of a photogenerator component, charge transport components, and a certain electron transport component, and a certain polymer binder.

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

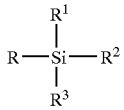

(II)

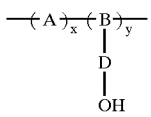

wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water (I)

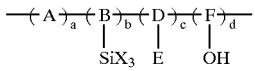

(II)

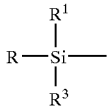

wherein, for example, A, B, D, and F represent the segments of the polymer backbone; E is an electron transporting moiety; Z is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in copending application U.S. Ser. No. 0/144,147, Publication No. 20030211413, entitled Imaging Members, filed May 10, 2002 by Liang-Bih et al., the disclosure of which is totally incorporated herein by reference, is a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

The appropriate components and processes of the above copending applications may be selected for the present invention in embodiments thereof.

BACKGROUND

This invention is generally directed to imaging members, and more specifically, the present invention is directed to multilayered photoconductive imaging members with a hole blocking layer comprised, for example, of a suitable hole blocking component of, for example, TiSi, and an electron transport component usually present in dopant amounts, such as for example, from about 1 to about 10, and more specifically, from about 2 to about 5 weight percent based on the components present in the hole blocking layer. The doped blocking layers enable, for example, additional pathways for electron transport thereby allowing excellent electron transport and low residual voltages, Vr; thicker hole blocking or undercoat layers, and which thicker layers permit excellent resistance to charge deficient spots, or undesirable plywooding, and increase the layer coating robustness, and wherein honing of the supporting substrates is eliminated thus permitting, for example, the generation of economical imaging members. The hole blocking layer is preferably in contact with the supporting substrate and is preferably situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

The imaging members of the present invention in embodiments exhibit excellent cyclic/environmental stability, and substantially no adverse changes in their performance over extended time periods since the imaging members comprise a mechanically robust and solvent thick resistant hole blocking layer enabling the coating of a subsequent photogenerating layer thereon without structural damage, and which blocking layer can be easily coated on the supporting substrate by various coating techniques of, for example, dip or slot-coating. The aforementioned photoresponsive, or photoconductive imaging members can be negatively charged when the photogenerating layer is situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

SUMMARY

It is a feature of the present invention to provide imaging members with many of the advantages illustrated herein, such as a thick hole blocking layer that prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present invention relates to the provision of layered photoresponsive imaging members, which are responsive to near infrared radiation of from about 700 to about 900 nanometers.

It is yet another feature of the present invention to provide layered photoresponsive imaging members with a sensitivity to visible light, and which members possess improved coating characteristics, and wherein the charge transport molecules do not diffuse, or there is minimum diffusion thereof into the photogenerating layer.

Moreover, another feature of the present invention relates to the provision of layered photoresponsive imaging members with mechanically robust and solvent resistant hole blocking layers.

Aspects of the present invention relate to a photoconductive imaging member comprised of a supporting substrate, a hole blocking layer thereover, a photogenerating layer and a charge transport layer, and wherein the hole blocking layer is comprised of, for example, of a mixture of $TiO_2$, $SiO_2$ and polypolymer binder (TiSi) and an electron transport component of, for example, N,N'-bis(1,2-dimethylpropyl)-1,4,5,8-naphthalenetetracarboxylic diimide; a photoconductive imaging member comprised of a substrate, a hole blocking layer thereover, a photogenerating layer, and a charge transport layer, and wherein the hole blocking layer is comprised of a metallic component, for example a particle dispersion of titanium oxide like $TiO_2$, a silicon oxide like $SiO_2$, and a suitable resin, and an electron transport component; an imaging member wherein the metallic component is present in an amount of from about 20 to about 95 weight percent; a member wherein the metallic component is TiSi, and more specifically, a mixture of a titanium oxide, a silicon oxide, and a polymer or resin binder, such as a phenol resin, optionally present in an amount of from about 30 to about 80 weight percent; a device wherein the metallic compound is TiSi present in an amount of from about 94 to about 98 weight percent; a photoconductive device containing an electron transport of N,N'-bis(1,2-dimethylpropyl)-1,4,5,8-naphthalenetetracarboxylic acid; bis(2-heptylimido) perinone; BCFM, butoxy carbonyl fluorenylidene malononitrile; benzophenone bisimide; or a substituted carboxybenzylnaphthaquinone; a photoconductive imaging member wherein the hole blocking layer contains 3-aminopropyl trimethoxysilane, 3-aminopropyl triethoxysilane, or mixtures thereof; a photoconductive imaging member wherein the hole blocking layer is of a thickness of about 1 to about 15 microns, or is of a thickness of about 2 to about 6 microns; a photoconductive imaging member comprised in sequence of a supporting substrate, a hole blocking layer, an adhesive layer, a photogenerating layer and a charge transport layer; a photoconductive imaging member wherein the adhesive layer is comprised of a polyester with, for example, an $M_w$ of about 70,000, and an $M_n$ of about 35,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 12 microns; a photoconductive imaging member wherein the charge, such as hole transport layer, is of a thickness of from about 10 to about 55 microns; a photoconductive imaging member wherein the photogenerating layer is comprised of photogenerating pigments in an amount of from about 10 percent by weight to about 95 percent by weight dispersed in a resinous binder; a photoconductive imaging member wherein the resinous binder is selected from the group consisting of polyesters, polyvinyl butyrals, polycarbonates, polystyrene-b-polyvinyl pyridine, and polyvinyl formals; a photoconductive imaging member wherein the charge transport layers comprise aryl amine molecules, and other known charges, especially hole transports; a photoconductive imaging wherein the charge transport aryl amines are of the formula

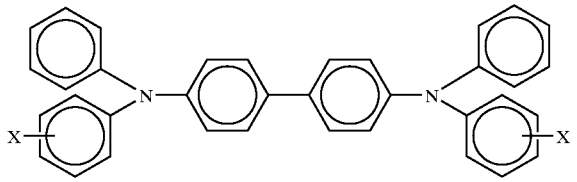

wherein X is alkyl, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methylphenyl)-1,1'-biphenyl-4,4'-diamine; a photoconductive imaging member further including an adhesive layer of a polyester with an $M_w$ of about 75,000, and an $M_n$ of about 40,000; a photoconductive imaging member wherein the photogenerating layer is comprised of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; and a method of imaging which comprises generating an electrostatic latent image on the imaging member illustrated herein, developing the latent image, and transferring the developed electrostatic image to a suitable substrate.

The hole blocking layers for the imaging members of the present invention contain an electron transport component selected, for example, from the group consisting of N,N'-bis(1,2-dimethylpropyl)-1,4,5,8-naphthalenetetracarboxylic diimide represented by the following formula

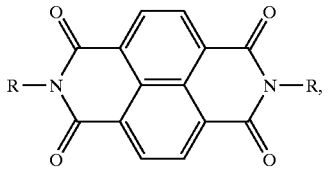

1,1'-dioxo-2-(4-methylphenyl)-6-phenyl-4-(dicyanomethylidene)thiopyran represented by the following formula

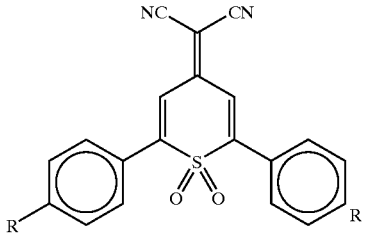

wherein R and R are independently selected from the group consisting of hydrogen, alkyl with, for example, 1 to about 4 carbon atoms, alkoxy with, for example, 1 to about 4 carbon atoms, and halogen; aquinone selected, for example, from the group consisting of carboxybenzylnaphthaquinone represented by the following formula

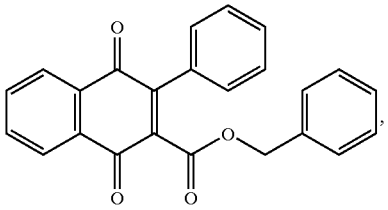

tetra(t-butyl) diphenolquinone represented by the following formula

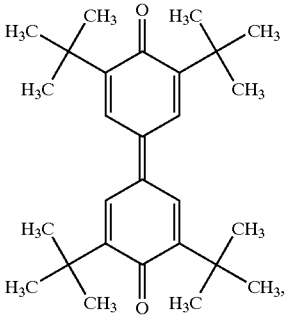

mixtures thereof, and the like; the butoxy derivative of carboxyfluorenone malononitrile; the 2-ethylhexanol of carboxyfluorenone malononitrile; the 2-heptyl derivative of N,N'-bis(1,2-diethylpropyl)-1,4,5,8-naphthalenetetracarboxylic diimide; and the sec-isobutyl and n-butyl derivatives of 1,1-(N,N'-bisalkyl-bis-4-phthalimido)-2,2-biscyano-ethylene.

Specific, and in embodiments preferred, electron transport components are those that are soluble in the solvent matrix illustrated herein, and which components are, for example, carboxyfluorenone malononitrile (CFM) derivatives represented by

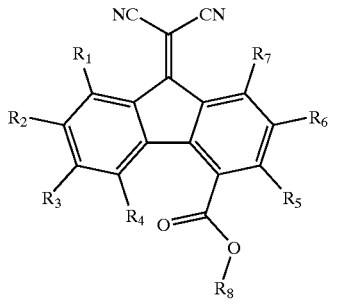

wherein each R is independently selected from the group consisting of hydrogen, alkyl having 1 to about 40 carbon atoms (for example, throughout with respect to the number of carbon atoms), alkoxy having 1 to about 40 carbon atoms, phenyl, substituted phenyl, higher aromatic such as naphthalene and anthracene, alkylphenyl having 6 to about 40 carbons, alkoxyphenyl having 6 to 40 carbons, aryl having 6 to 30 carbons, substituted aryl having 6 to about 30 carbons and halogen; or a nitrated fluorenone derivative represented by

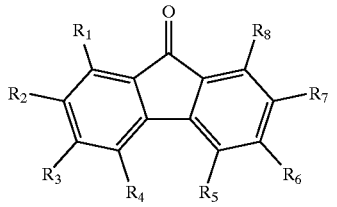

wherein each R is independently selected from the group consisting of hydrogen, alkyl, alkoxy, aryl, such as phenyl, substituted phenyl, higher aromatics such as naphthalene and anthracene, alkylphenyl, alkoxyphenyl, carbons, substituted aryl and halogen, and wherein at least 2 R groups are nitro; a N,N'-bis(dialkyl)-1,4,5,8-naphthalenetetracarboxylic diimide derivative or N,N'-bis(diaryl)-1,4,5,8-naphthalenetetracarboxylic diimide derivative represented by the general formula/structure

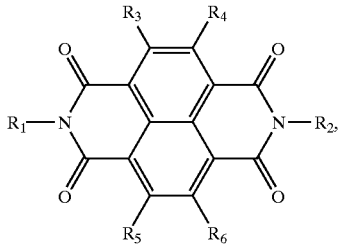

wherein $R_1$ is, for example, substituted or unsubstituted alkyl, branched alkyl, cycloalkyl, alkoxy or aryl, such as phenyl, naphthyl, or a higher polycyclic aromatic, such as anthracene; $R_2$ is alkyl, branched alkyl, cycloalkyl, or aryl, such as phenyl, naphthyl, or a higher polycyclic aromatics, such as anthracene, or wherein $R_2$ is the same as $R_1$; $R_1$ and $R_2$ can independently possess from 1 to about 50 carbons, and more specifically, from 1 and about 12 carbons. $R_3$, $R_4$, $R_5$ and $R_6$ are alkyl, branched alkyl, cycloalkyl, alkoxy or aryl, such as phenyl, naphthyl, or a higher polycyclic aromatics such as anthracene or halogen and the like. $R_3$, $R_4$, $R_5$ and $R_6$ can be the same or different; a 1,1'-dioxo-2-(aryl)-6-phenyl-4-(dicyanomethylidene)thiopyran

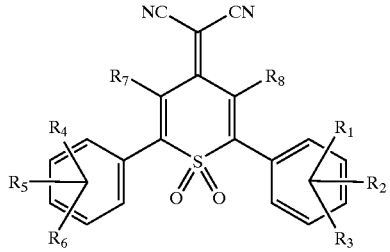

wherein each R is, for example, independently selected from the group consisting of hydrogen, alkyl with 1 to about 40 carbon atoms, alkoxy with 1 to about 40 carbon atoms, phenyl, substituted phenyl, higher aromatics such as naphthalene and anthracene, alkylphenyl with 6 to about 40 carbons, alkoxyphenyl with 6 to about 40 carbons, aryl with 6 to about 30 carbons, substituted aryl with 6 to about 30 carbons and halogen; a carboxybenzyl naphthaquinone represented by the following

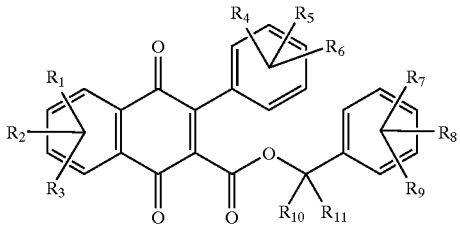

and/or

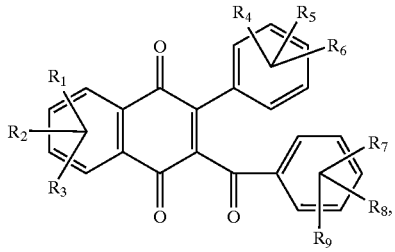

wherein each R is independently selected from the group consisting of hydrogen, alkyl with 1 to about 40 carbon atoms, alkoxy with 1 to about 40 carbon atoms, phenyl, substituted phenyl, higher aromatics such as naphthalene and anthracene, alkylphenyl with 6 to about 40 carbons, alkoxyphenyl with 6 to about 40 carbons, aryl with 6 to about 30 carbons, substituted aryl with 6 to about 30 carbons and halogen; a diphenoquinone represented by the following

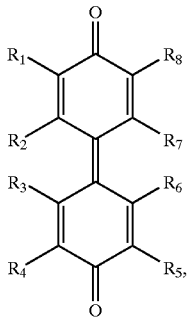

and mixtures thereof, wherein each of the R substituents are as illustrated herein; or oligomeric and polymeric derivatives in which the above moieties represent part of the oligomer or polymer repeat units, and mixtures thereof wherein the mixtures can contain from 1 to about 99 weight percent of one electron transport component and from about 99 to about 1 weight percent of a second electron transport component, and which electron transports can be dispersed in a resin binder, and wherein the total thereof is about 100 percent.

Examples of the hole blocking layer component include $TiO_2/SiO_2$/VARCUM resin at 52:10:38 weight ratio in a 1:1 mixture of n-butanol:xylene containing from about 2 to about 50 weight percent of added electron transport material based on total solid concentration in solution, and other known hole blocking layer components, and wherein the aforementioned main component amount is, for example, from about 80 to about 100, and more specifically, from about 90 to about 99 weight percent.

The hole blocking layer can in embodiments be prepared by a number of known methods; the process parameters being dependent, for example, on the member desired. The hole blocking layer can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 1 to about 15 microns after drying.

Illustrative examples of substrate layers selected for the imaging members of the present invention can be opaque or substantially transparent, and may comprise any suitable material having the requisite mechanical properties. Thus, the substrate may comprise a layer of insulating-material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2/SiO_2$, the components of copending application U.S. Ser. No. 10/144,147, filed May 10, 2002, the disclosure of which is totally incorporated herein by reference, and the like.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns, and more specifically, about 1 micron. Optionally, this layer may contain effective suitable amounts, for example from about 1 to about 10 weight percent, conductive and nonconductive particles, such as zinc oxide, titanium dioxide, silicon nitride, carbon black, and the like; to provide, for example, in embodiments of the present invention further desirable electrical and optical properties.

Various suitable know charge transport compounds, molecules and the like can be selected for the charge transport layer, such as aryl amines of the following formula

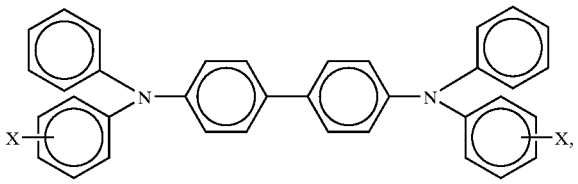

and wherein a thickness thereof is, for example, from about 5 microns to about 75 microns, and from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

An illustrative photoresponsive imaging device incorporating the blocking layer of the present invention was fabricated as follows.

A 30 millimeter aluminum drum substrate was coated using known dip coating techniques with a hole blocking layer from a solution of $TiO_2$, 52 weight percent, $SiO_2$, 10 weight percent, a known phenolic resin binder, 38 weight percent, electron transport dopant illustrated herein, such as NTDI or BCFM, at about 2, 5 or 10 weight percent of the total solid concentration in a 1:1 n-butanol:xylene solvent mixture. After drying at 145° C. for 45 minutes, a blocking layer (HBL) of about 6 to about 7 microns in thickness was obtained. A 0.2 micron photogenerating layer was subsequently coated on top of the hole blocking layer from a dispersion of chlorogallium phthalocyanine (0.60 gram) and a binder of polystyrene-b-polyvinylpyridine vinyl chloride-vinyl acetate-maleic acid terpolymer (0.40 gram) in 20 grams of a 1:1 mixture of n-butylacetate:xylene solvent. Subsequently, a 22 micron charge transport layer (CTL) was coated on top of the photogenerating layer from a solution of N,N'-diphenyl-N,N-bis(3-methyl phenyl)-1,1'-biphenyl-4,4'-diamine (31 grams), N,N'-bis-(3,4-dimethylphenyl)-4,4'-biphenyl amine (17 grams), and a MAKROLON® polycarbonate (5.2 grams) in 50 grams of 3:1 mixture of tetrahydrofuran and toluene.

The xerographic electrical properties of the imaging members can be determined by known means, including as indicated herein electrostatically charging the surfaces thereof with a corona discharge source until the surface potentials, as measured by a capacitively coupled probe attached to an electrometer, attained an initial value $V_o$ of about −700 volts. Each member was then exposed to light from a 670 nanometer laser with >100 erg/cm$^2$ exposure energy, thereby inducing a photodischarge which resulted in a reduction of surface potential to a Vr value, residual potential. The following table summarizes the cyclic electrical performance of these devices to 20,000 cycles, and which table data illustrates the electron transport enhancement of illustrative photoconductive members of the present invention. Specifically, while the primary transport-in the layer occurs through the $TiO_2$, additional pathways for electron transport are enabled by the inclusion of the specific electron transport molecule dopants illustrated herein. The enhancement in electron mobility was demonstrated by both the decrease in Vr and in the decreased dark conductivity. These parameters indicate that a greater amount of charge was moved out of the photoreceptor, resulting in a lower residual potential and a decreased rate of dark discharge.

| Data @ 20K Cycles | Vo | Vr | DD (V/s) |
|---|---|---|---|
| Undoped Sample (6 μm) | 711.6 | 71.6 | 121.6 |
| 2% NQN-2 (6 μm) | 702.6 | 60.2 | 110.1 |
| 2% 2EHCFM (7 μm) | 706.8 | 62.3 | 112.2 |
| 2% 2H-NTDI (6 μm) | 706.9 | 63.1 | 107.5 |
| 2% Bis(secbut)BIBCN (6.7 μm) | 712.1 | 80.1 | 110.6 |
| 2% Bis(isobut)BIBCN (6 μm) | 707.2 | 61.9 | 116.0 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a supporting substrate, a hole blocking layer thereover, a photogenerating layer, and a charge transport layer, and wherein the hole blocking layer is comprised of a metallic component and an electron transport component.

2. An imaging member in accordance with claim 1 wherein said metallic component is $TiO_2$.

3. An imaging member in accordance with claim 2 wherein said metallic component is comprised of a metal containing dispersion of a titanium oxide, a silicon oxide, and a resin optionally present in an amount of from about 94 to about 98 weight percent.

4. An imaging member in accordance with claim 2 wherein said metallic component is comprised of a metal containing dispersion of a titanium oxide, a silicon oxide, and a resin present in an amount of from about 96 to about 98 weight percent.

5. An imaging member in accordance with claim 2 wherein said electron transport component is (4-n-butoxycarbonyl-9-fluorenylidene) malononitrile, 2-methylthioethyl 9-dicyanomethylenefluorene-4-carboxylate, 2-(3-thienyl)ethyl 9-dicyanomethylene fluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone.

6. An imaging member in accordance with claim 2 wherein said electron transport component is (4-n-butoxycarbonyl-9-fluorenylidene) malononitrile.

7. An imaging member in accordance with claim 1 wherein said metallic component is a metal oxide.

8. An imaging member in accordance with claim 1 wherein said metallic component is present in an amount of from about 20 to about 90 weight percent.

9. An imaging member in accordance with claim 1 wherein said metallic component is present in an amount of from about 30 to about 80 weight percent.

10. An imaging member in accordance with claim 1 wherein said electron transport component is N,N'-bis(1,2-dimethylpropyl)-1,4,5,8-naphthalenetetracarboxylic acid; bis(2-heptylimido)perinone; BCFM, butoxy carbonyl fluorenylidene malononitrile; benzophenone bisimide; or a substituted carboxybenzylnaphthaquinone.

11. An imaging member in accordance with claim 10 wherein said substituted carboxybenzylnaphthaquinone is substituted with alkyl.

12. An imaging member in accordance with claim 10 wherein said electron transport component is present in a dopant amount of from about 1 to about 15 weight percent.

13. An imaging member in accordance with claim 10 wherein said electron transport component is present in an amount of from about 2 to about 10 weight percent.

14. An imaging member in accordance with claim 10 wherein said electron transport component is present in an amount of from about 2 to about 4 weight percent.

15. An imaging member in accordance with claim 1 wherein said electron transport component is N,N'-bis(1,2-dimethylpropyl)-1,4,5,8-naphthalenetetracarboxylic acid.

16. An imaging member in accordance with claim 1 wherein said electron transport component is bis(2-heptylimido)perinone.

17. An imaging member in accordance with claim 1 wherein said electron transport component is a butoxy carbonyl fluorenylidene malononitrile.

18. An imaging member in accordance with claim 1 wherein said electron transport component is benzophenone.

19. An imaging member in accordance with claim 1 wherein said electron transport component is present in an amount of from about 1 to about 15 weight percent.

20. An imaging member in accordance with claim 1 wherein said electron transport component is selected in an amount of from about 2 to about 10 weight percent.

21. An imaging member in accordance with claim 1 wherein said electron transport component is selected in an amount of from about 2 to about 4 weight percent.

22. An imaging member in accordance with claim 1 wherein said hole blocking layer is of a thickness of about 2 to about 12 microns.

23. An imaging member in accordance with claim 1 wherein said electron transport component is (4-n-butoxycarbonyl-9-fluorenylidene) malononitrile (BCFM), 2-methylthioethyl 9-dicyanomethylenefluorene-4-carboxylate, 2-(3-thienyl)ethyl 9-dicyanomethylene fluorene-4-carboxylate, 2-phenylthioethyl 9-dicyanomethylenefluorene-4-carboxylate, 11,11,12,12-tetracyano anthraquinodimethane or 1,3-dimethyl-10-(dicyanomethylene)-anthrone.

24. An imaging member in accordance with claim 23 wherein the adhesive layer is comprised of a polyester with an $M_w$ of from about 45,000 to about 75,000, and an $M_n$ of from about 25,000 to about 40,000.

25. An imaging member in accordance with claim 1 wherein said electron transport component is (4-n-butoxycarbonyl-9-fluorenylidene) malononitrile.

26. An imaging member in accordance with claim 1 comprised in the following sequence of said supporting substrate, said hole blocking layer, an adhesive layer, said photogenerating layer, and said charge transport layer, and wherein said layer is a hole transport layer.

27. An imaging member in accordance with claim 1 wherein the supporting substrate is comprised of a conductive metal substrate, and optionally which substrate is aluminum, aluminized polyethylene terephthalate, or titanized polyethylene terephthalate.

28. An imaging member in accordance with claim 1 wherein said photogenerator layer is of a thickness of from about 0.05 to about 10 microns, and wherein said transport layer is of a thickness of from about 10 to about 50 microns.

29. An imaging member in accordance with claim 1 wherein the photogenerating layer is comprised of photogenerating pigments dispersed in a resinous binder in an optional amount of from about 5 percent by weight to about 95 percent by weight, and optionally wherein the resinous binder is selected from the group consisting of polyesters, polyvinyl butyrals, polycarbonates, polystyrene-b-polyvinyl pyridine, and polyvinyl formals.

30. An imaging member in accordance with claim 1 wherein the charge transport layer comprises aryl amines, and which aryl amines are of the formula

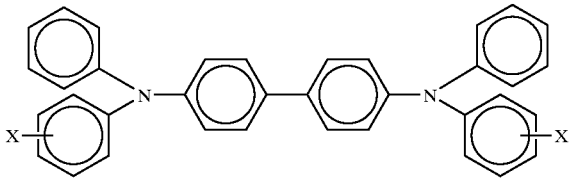

wherein X is selected from the group consisting of alkyl and halogen.

31. An imaging member in accordance with claim 30 wherein alkyl contains from about 1 to about 10 carbon atoms, or wherein alkyl contains from 1 to about 5 carbon atoms, or optionally wherein alkyl is methyl, wherein halogen is chlorine, and wherein there is further included a resinous binder selected from the group consisting of polycarbonates and polystyrenes.

32. An imaging member in accordance with claim 30 wherein the aryl amine is N,N'-diphenyl-N,N-bis(3-methyl phenyl)-1,1'-biphenyl-4,4'-diamine.

33. An imaging member in accordance with claim 1 wherein the photogenerating layer is comprised of metal phthalocyanines, hydroxygallium phthalocyanines, chlorogallium phthalocyanines, or metal free phthalocyanines.

34. An imaging member in accordance with claim 1 wherein the photogenerating layer is comprised of titanyl phthalocyanines, perylenes, or halogallium phthalocyanines.

35. An imaging member in accordance with claim 1 wherein the photogenerating layer is comprised of chlorogallium phthalocyanines.

36. A method of imaging which comprises generating an electrostatic latent image on the imaging member of claim 1, developing the latent image, and transferring the developed electrostatic image to a suitable substrate.

37. An imaging member in accordance with claim 1 wherein said hole blocking layer is of a thickness of about 2 to about 4 microns.

38. An imaging member in accordance with claim 1 wherein said member comprises, in sequence, said supporting layer, said hole blocking layer, said photogenerating layer, and said charge transport, and wherein said charge transport is a hole transport; and wherein said hole blocking layer is comprised of an electron transport selected from the group consisting of N,N'-bis(1,2-dimethylpropyl)-1,4,5,8-naphthalenetetracarboxylic diimide represented by the formula

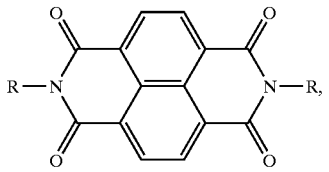

1,1'-dioxo-2-(4-methylphenyl)-6-phenyl-4-(dicyanomethylidene) thiopyran represented by the following structural formula

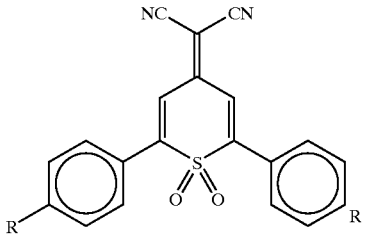

wherein R is independently selected from the group consisting of hydrogen, alkyl with 1 to about 4 carbon atoms, alkoxy and halogen, and a quinone selected from the group consisting of carboxybenzylnaphthaquinone represented by the formula

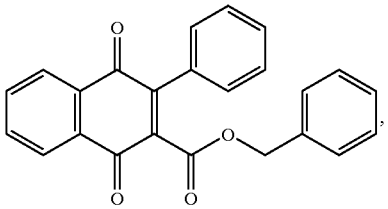

and tetra(t-butyl) diphenolquinone represented by the following structural formula

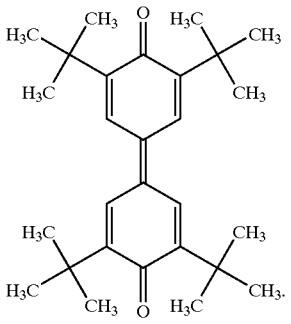

39. An imaging member in accordance with claim 1 wherein said metallic component is comprised of a particle dispersion of a titanium oxide ($TiO_2$), a silicon oxide ($SiO_2$), and a resin.

40. A photoconductive imaging member comprised of a hole blocking layer thereover, a photogenerating layer, and a charge transport layer, and wherein the hole blocking layer is comprised of a metallic component and an electron transport component.

41. An imaging member in accordance with claim 40 wherein said metallic component is a titanium oxide.

42. A xerographic apparatus comprised of charging component, an imaging component, a transfer component, a development component, and a fixing component; and wherein the imaging component is comprised of a photoconductive imaging member comprised of a supporting substrate, a hole blocking layer thereover, a photogenerating layer, and a charge transport layer, and wherein the hole blocking layer is comprised of a metallic component and an electron transport component.

* * * * *